US005260698A

United States Patent [19]

Munetsugu et al.

[11] Patent Number: 5,260,698

[45] Date of Patent: Nov. 9, 1993

[54] INTEGRATED CIRCUIT FOR LIQUID CRYSTAL DISPLAY

[75] Inventors: Eiichi Munetsugu; Hirofumi Saita, both of Yokohama, Japan

[73] Assignee: Kabushiki Kaisha Toshiba, Kawasaki, Japan

[21] Appl. No.: 715,890

[22] Filed: Jun. 19, 1991

Related U.S. Application Data

[63] Continuation of Ser. No. 373,615, Jun. 29, 1989, abandoned, which is a continuation of Ser. No. 82,534, Aug. 7, 1987, abandoned.

[30] Foreign Application Priority Data

Aug. 13, 1986 [JP] Japan ..... 61-190119

[51] Int. Cl.[5] ..... G09G 3/36

[52] U.S. Cl. ..... 345/205; 345/103

[58] Field of Search ..... 340/784, 719, 718

[56] References Cited

U.S. PATENT DOCUMENTS

| | | | |
|---|---|---|---|
| 3,590,328 | 6/1971 | Frescura et al. | 340/718 |
| 4,549,174 | 10/1985 | Funada | 340/718 |
| 4,688,896 | 8/1987 | Castleberry | 340/784 |
| 4,830,466 | 5/1989 | Matsuhashi et al. | 340/784 |

FOREIGN PATENT DOCUMENTS

| | | |
|---|---|---|
| 2106690 | 4/1983 | United Kingdom . |
| 2138615 | 10/1984 | United Kingdom . |

OTHER PUBLICATIONS

Catalogue of Hitachi Driver "HD 44102," (Mar. 1987).

*Primary Examiner*—Jeffery Brier

*Attorney, Agent, or Firm*—Finnegan, Henderson, Farabow, Garrett & Dunner

[57] ABSTRACT

The pixel drive output terminals of an integrated circuit for liquid crystal display are grouped into two array-portions, one of the array-portions including odd numbered output terminals associated with the odd numbered pixels and the other of array-portions including even numbered output terminals associated with the even numbered pixels.

2 Claims, 5 Drawing Sheets

FIG. 5
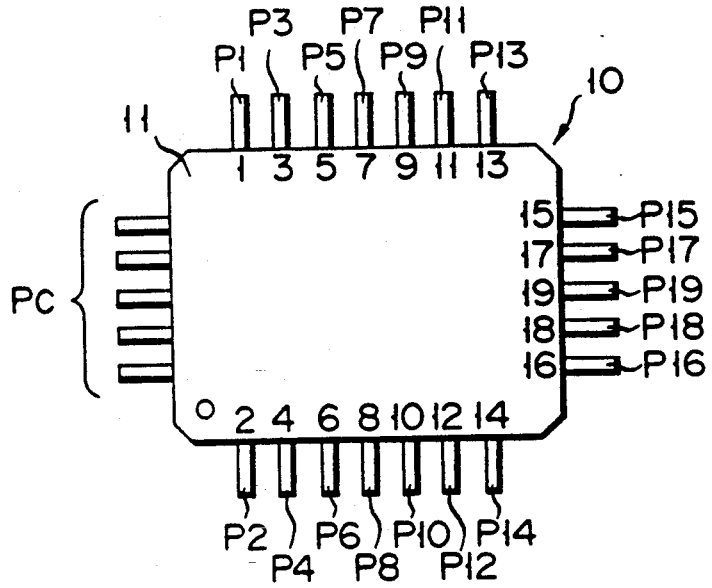
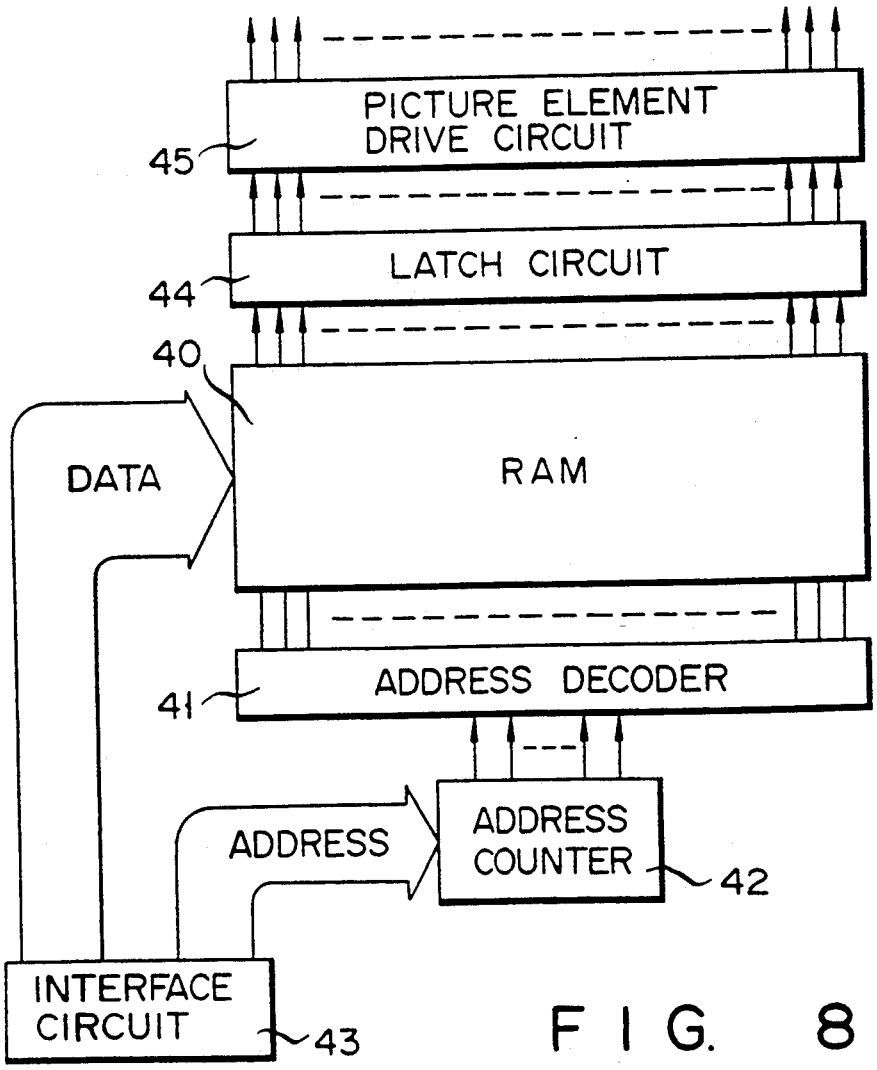
FIG. 8

INTEGRATED CIRCUIT FOR LIQUID CRYSTAL DISPLAY

This application is a continuation of application Ser. No. 07/373,615 filed Jun. 29, 1989, now abandoned, which is a continuation of application Ser. No. 07/082,534, filed Aug. 7, 1987, now abandoned.

BACKGROUND OF THE INVENTION

This invention relates to an integrated circuit for liquid crystal display, for driving a dot matrix type liquid crystal display and, more particularly, to an improvement in an arrangement of output terminals for outputting a plurality of pixel or picture element drive signals in a parallel fashion.

FIG. 1 is a schematic illustration of a liquid crystal (LC) display apparatus. In the figure, reference numeral 51 designates a liquid crystal display device, 52 a semiconductor integrated circuit, for example, a large scale integration (LSI) for driving the LC display device, and 53 a printed wiring board, i.e., printed wiring substrate. The output signal terminals (not shown) of board 53 and the electrode terminals of the LC display device 51 are connected by conductive wires (not shown).

When an LC display device with picture elements (pixels) arrayed in a matrix fashion, called a dot matrix type LC display device, is used, LSI 52 is so constructed as to produce a plurality of pixel drive signals in a parallel fashion. An array of external terminals of a conventional LSI is illustrated in FIG. 2. In the figure, reference numeral 61 designates a package, Pl to P19 pixel drive output terminals for outputting the pixel drive signals, and Pc control terminals for control signal. Output terminals P1 to P19 are numbered 1, 2, 3, . . . , 19 in a direction, respectively.

The drive signals output from the output terminals P1 to P19 of LSI 52 are applied to those pixels of the pixel array of LC display device 51 which correspond to the output terminals P1 to P19 of LSI 52.

A conventional structure of dot matrix type LC display device 51 is illustrated in FIG. 3. The LC display device 51 is comprised of a pair of transparent substrates made of, for example, glass, a plurality of transparent electrodes for pixel drive, which are arrayed on the inner surfaces of the transparent substrates, liquid crystal filled in the space between the paired transparent substrates, and light directing boards laid on the outer surfaces of the transparent substrates. The center portion of the transparent substrates constitutes a display section 71. The extended portions of the transparent electrodes form a wiring section 72 and electrode terminal section 73. In display section 71, the transparent electrodes constituting common electrodes (in this example, five electrodes) extend in the horizontal direction of the substrates. The transparent electrodes constituting segment electrodes (in this example, twenty electrodes) are arrayed in the vertical direction of the substrates. Electrode terminals $73_1$ to $73_{20}$ are connected to the segment transparent electrodes, located at the ends of the substrates in the horizontal direction, and numbered 1, 2, 3, . . . , 20 in the horizontal direction, respectively. These electrode terminals are grouped into array-portions. The array-portions are alternately arranged on both sides of the substrate. The terminals in each array-portion are successively arrayed in the order of the terminal numbers.

When LC drive LSIs 52 with the external terminal array shown in FIG. 2 are used to drive dot matrix type LC display devices 51 with the electrode terminal array shown in FIG. 3, the wiring pattern of the printed wiring board used for carrying the LSIs 52 is illustrated in FIG. 4. The output signal terminals of printing wiring substrate 53 are located at the ends thereof in the horizontal direction, and grouped into array portions 82. The output terminals of each LSI 52 for outputting pixel drive signals are connected to the corresponding array-portions of the output signal terminal of substrate 53, via printed wirings 81 for leading the drive signals. However, array-portions 82 of substrate 53 are alternately located at both sides of the printed wiring board, and the order of the terminal numbers in each array-portion 82 is the same as that in the corresponding array-portion of the electrode terminals of LC display device 51. Consequently, the order of the terminal numbers of half of the output terminals of each LSI 52 is opposite to the order of the terminal numbers of the output terminals of printed wiring board 53. If those terminals oppositely arrayed are connected on the same surface of board 53, wirings 81 connecting the oppositely arrayed terminals cross with each other. In order to avoid this problem conventionally, the printed wirings are formed on both surfaces of printed wiring board 53, as shown in FIG. 4. The printed wires formed on the back surface are indicated by dotted lines. The wirings formed on both surfaces are connected via contact-holes 83.

Drive signals are applied, in a time division manner, to the electrode terminals $73_1$ to $73_{20}$ of LC display device 51. The LC drive circuit (not shown) for generating the drive signal is mounted on printed wiring board 53. The printed wirings (not shown) for supplying the drive signals, and their output signal terminals (not shown) are provided on printed wiring board 53.

If such a layout of wirings is employed for avoiding the crossing of wirings, a number of contact-holes 83 must be formed. As a result, the cost to manufacture printed wiring board 53 is increased, and the reliability of the wiring connection is reduced.

In an LC display device 51 as shown in FIG. 3, the electrode terminals in each array-portion are successively arrayed in the order of terminal number in the horizontal direction of the display device. Therefore, as the number of electrode terminals is increased, the wiring portion 72 between electrode terminal section 73 and display section 71 occupies a large area on the chip. As a result, the ratio of the occupied area of display 71 in LC display device is reduced. The result is that the manufactured displayed image is unreadable, and the ineffective portion of the liquid crystal layer which does not contribute to the display, is increased.

SUMMARY OF THE INVENTION

Accordingly, this invention is directed to solving the problem arising from the fact that it is required that the numerous contact-holes are formed in the printed wiring board for the integrated circuit, and the problem that the display section of the dot matrix type LC display device is narrow.

An object of this invention is to provide an integrated circuit for liquid crystal (LC) display, in which a wide display section in the dot matrix type LC display device can be secured, with reduced manufacturing cost of the printed wiring board and improved reliability of wirings, and which realizes an inexpensive and reliable LC display device of the dot matrix type.

In an integrated circuit for liquid crystal display according to the present invention, the output terminals for pixel drive signals for outputting in parallel a plurality of pixel drive signals, which are applied to the pixels arrayed in a direction in a liquid crystal display device of the dot matrix type, are grouped into two array-portions, an array-portion including odd numbered output terminals associated with the odd numbered pixels and an array-portion including even numbered output terminals associated with the even numbered pixels.

The odd numbered output terminals are arrayed such that the numbers thereof (odd numbers) are increased in a direction of the array of the odd numbered and even numbered output terminals. In such a case, the even numbered output terminals are arrayed such that the numbers thereof (even numbers) are decreased in the same direction of the array of the odd numbered and even numbered output terminals.

Alternatively, the odd numbered output terminals are arrayed such that the numbers thereof (odd numbers) are decreased in a direction of the array of the odd numbered and even numbered output terminals. In such a case, the even numbered output terminals are arrayed such that the numbers thereof (even numbers) are increased in the same direction of the array of the odd numbered and even numbered output terminals.

In mounting the integrated circuit for LC display with the output terminal array on the printed wiring board, an array-portion of the odd numbered board terminals and an array-portion of the even numbered board terminals are separately located on the printed wiring board, in correspondence to the output terminal array-portions of the integrated circuit for LC display. Consequently, the integrated circuit output terminals can be connected to the board output terminals on one surface of the board. This eliminates the need for the contact-hole connection of the printed wirings on both surface of the board. The result is to provide an inexpensive and reliable printed wiring board. In assembling an LC display apparatus by electrically connecting an LC display device of the dot matrix type on the printed wiring board, if the electrode terminals of the transparent substrate of the liquid crystal display device are grouped into an array-portion of the even numbered electrode terminals and an array-portion of the odd numbered electrode terminals, in correspondence to the output terminal array of the wiring board, the transparent wirings for connecting the transparent electrodes with the electrode terminals may extend substantially in vertical direction of the display device and may have a minimum length. The result is to increase the area occupied by the transparent electrode wiring section in the LC display device and to provide an easy-to-see display. The array interval between transparent electrode wirings, and hence the electrode terminal wiring interval may be as wide as the pixel wiring interval. This fact makes it easy to manufacture the LC display device, and provides an inexpensive LC display device.

BRIEF DESCRIPTION OF THE DRAWINGS

FIG. 5 shows a plan view illustrating an LSI for LC display according to an embodiment of this invention;

FIG. 8 shows a block diagram illustrating an example of the internal circuit of the LSI shown in FIG. 1.

DETAILED DESCRIPTION OF THE PREFERRED EMBODIMENT

Figure 1:
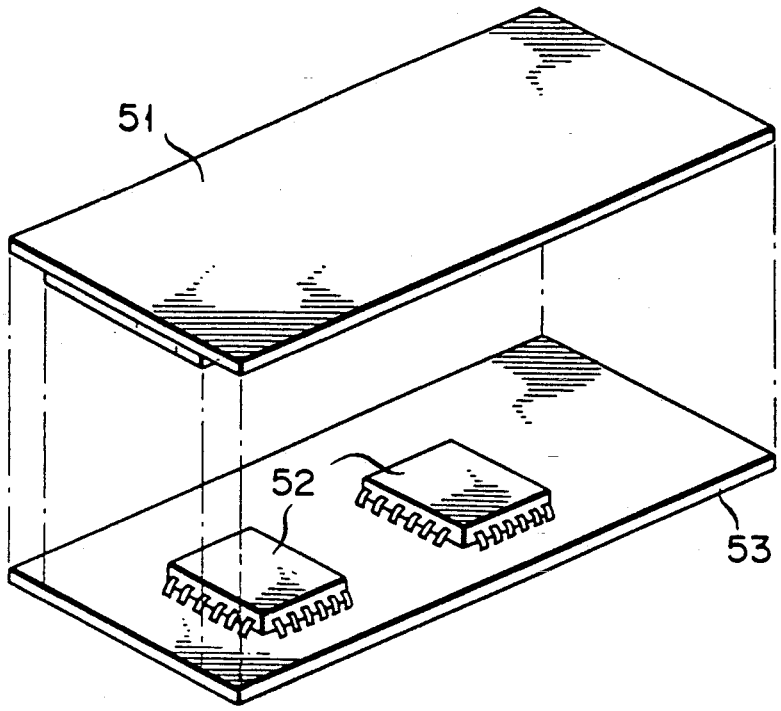
FIG. 1 shows a perspective view schematically showing an example of the LC display apparatus.
Figure 2:
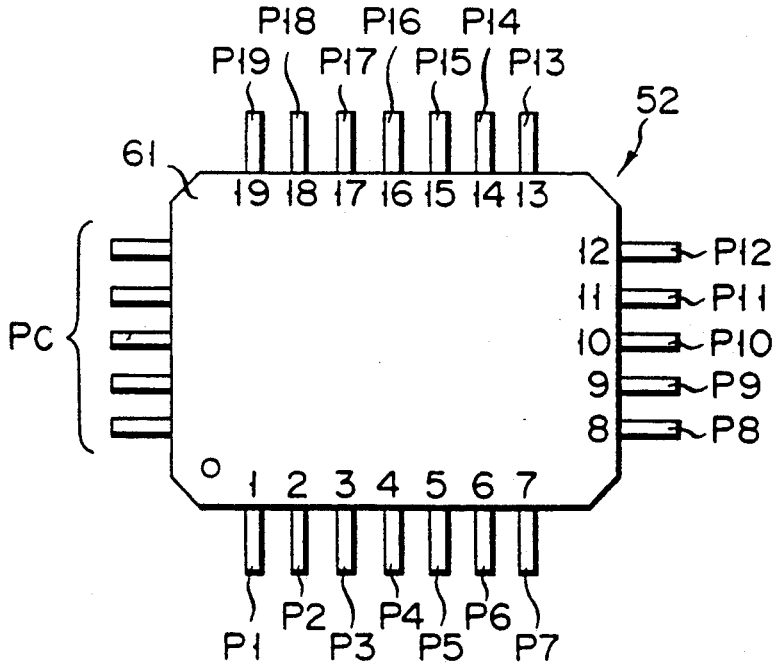
FIG. 2 PRIOR ART
FIG. 2 shows a plan view of a conventional LSI for LC display in FIG. 1.

An embodiment of this invention will be described referring to the accompanying drawings.

In LSI 10 for LC display as shown in FIG. 5, reference numeral 11 designates a package having Pc control terminals and P1 to P19 pixel drive output terminals for outputting in parallel the drive signals for driving the pixels or picture elements (not shown). An array-portion of the odd numbered ones of output terminals P1 to P19, which are provided in correspondence to the odd numbered pixels, is provided separately from an array-portion of the even numbered ones of output terminals P2 to P18. which are provided in correspondence to the even numbered pixels. The odd numbered output terminals are arrayed in an order so that the numbers assigned to these terminals increases in a direction of the array of the pixel drive output terminals. The even numbered output terminals are arrayed in an order so that the numbers assigned to these terminals decreases in the same direction of the array of the pixel drive output terminals.

In other words, the odd numbered output terminals are arrayed such that the numbers thereof (odd numbers) increase in a direction of the array of the odd numbered and even numbered output terminals. In such a case, the even numbered output terminals are arrayed such that the numbers thereof (even numbers) decrease in the same direction of the array of the odd numbered and even numbered output terminals.

Figure 9:
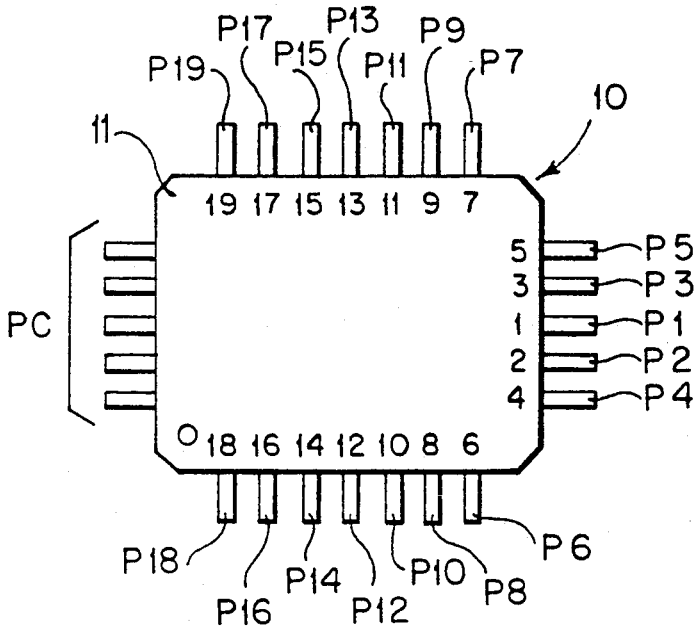
FIG. 9 shows a plan view illustrating an alternative embodiment of an LSI for LC display according to the present invention.

Alternatively, according to the invention the odd numbered output terminals may be arrayed such that the numbers thereof (odd numbers) decrease in a direction of the array of the odd numbered and even numbered output terminals. In such a case, the even numbered output terminals are arrayed such that the numbers thereof (even numbers) increase in the same direction of the array of the odd numbered and even numbered output terminals. This arrangement is shown in FIG. 9.

Figure 6:
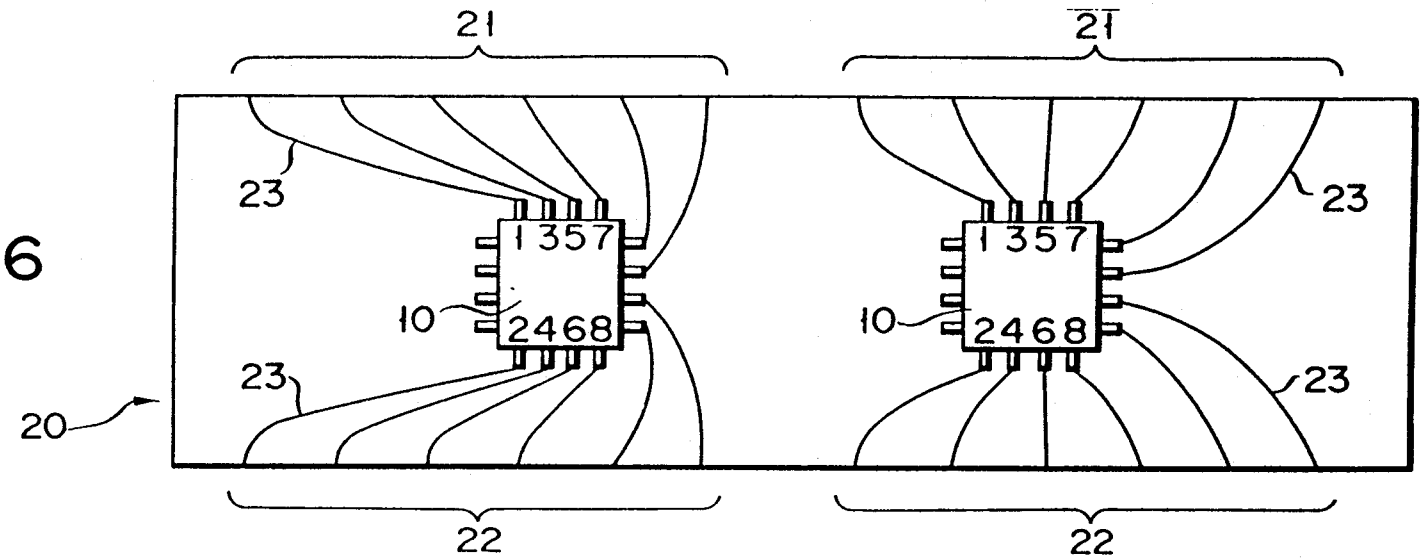
FIG. 6 shows a plan view illustrating an example of a printed wiring board for assembling an LC display apparatus together with the LSI of FIG. 1.

When the LC display LSI with such an output terminal array is mounted on a printed wiring board, the output terminal section for the pixel drive signal of the printed wiring board is electrically connected to the electrode terminal section of the dot matrix type LC display device by means of a conductive member (e.g., conductive rubber). The wiring board has two major planar surfaces and also has sides located towards the edges of the surfaces and connecting the surfaces at their perimeters. In such a case, as shown in FIG. 6, the array-portions of the odd and even numbered output terminals of LSI 10 can be connected to the array-portions 21 and 22 of even and odd numbered terminals of printing wiring board 20, which are alternately provided on both sides of board 20, on one surface of printed wiring board 20 via printed wirings 23 formed on the surface of board 20, without any crossing of the printed wirings 23. As a result, printed wiring board 20 can be manufactured at less cost than a conventional wiring board of the type in which the printed wirings are formed on both sides of the board 20 and interconnected through the contact-holes. Further, the reliability of the formed wirings is high.

Further formed on the printed wiring board 20 are a liquid crystal drive circuit (not shown) for supplying drive signals to the LC display in a time division manner, the printed wirings (not shown) associated with the drive circuit, and signal terminals (not shown). In FIG. 10, however; the output terminals of LSI 10 have been reduced for simplicity of illustration. The LC drive circuit and the LSI 10 are generally controlled by an MPU (microprocessor).

Figure 3:
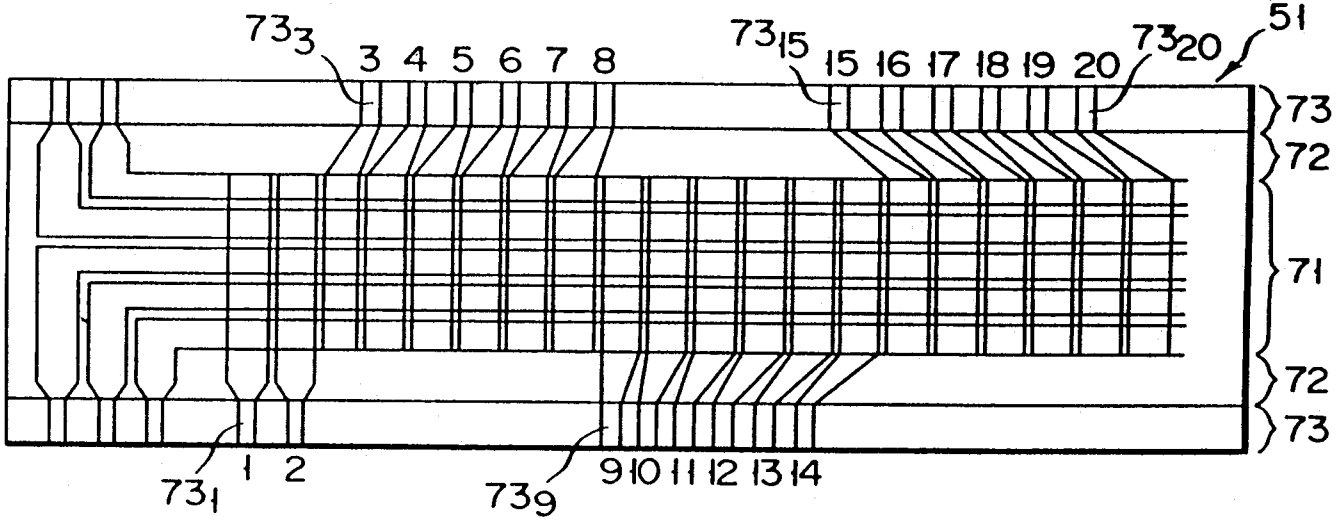
FIG. 3 PRIOR ART
FIG. 3 shows a plan view illustrating a conventional printed wiring board in FIG. 1.
Figure 4:
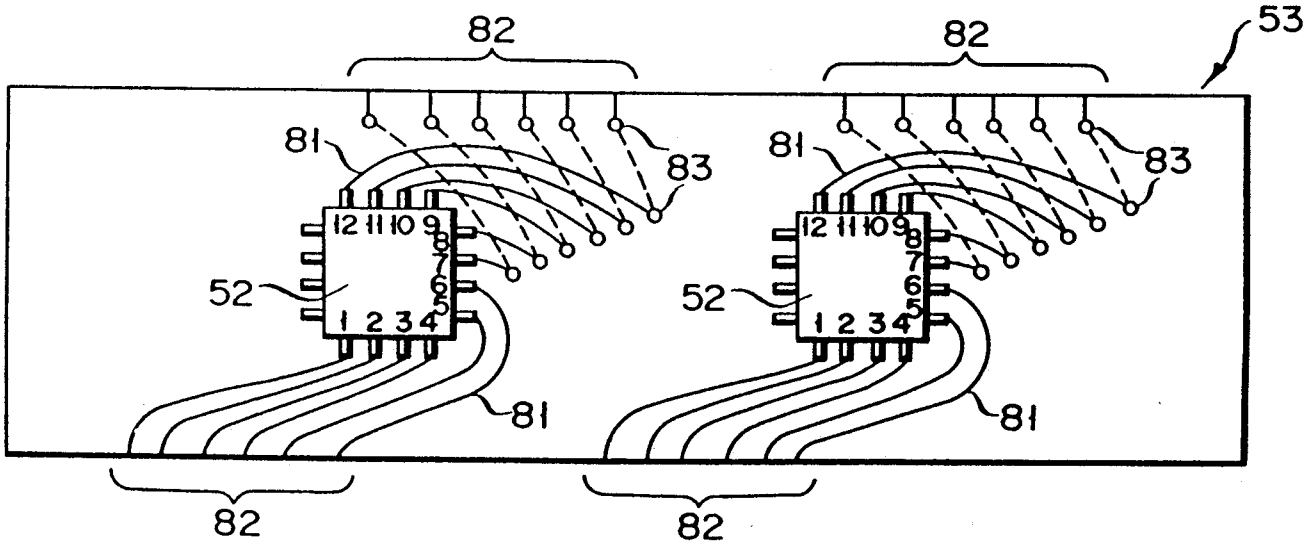
FIG. 4 shows a view illustrating an example of the LC display device in FIG. 1.
Figure 7:
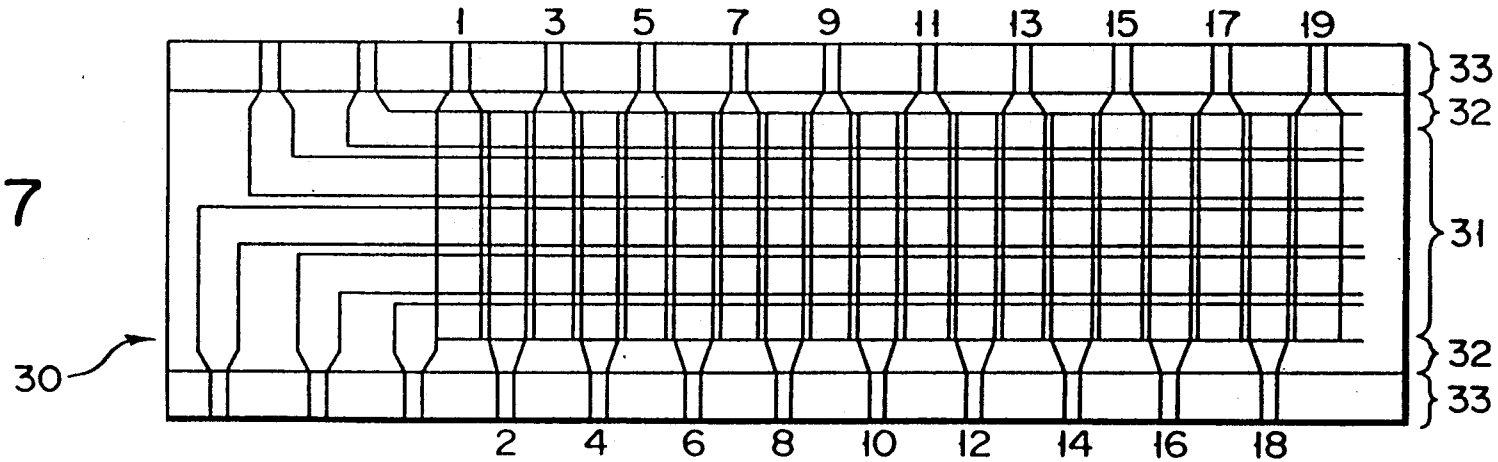
FIG. 7 shows a view illustrating a configuration of an example of an LC display apparatus of the dot matrix type.

An LC display device 30 of the dot matrix type may be used the device having the electrode terminal array shown in FIG. 7, which corresponds to the terminal array of printed wiring board as mentioned above. In the display device 30, array-portions of the odd and even numbered pixel drive electrode terminals 33 in the axial direction are separately arrayed on both sides of the transparent substrate. As a result, the wirings of the transparent electrode wiring section 32 located between the odd numbered transparent electrodes, on one hand, and the odd numbered electrode terminals, on the other hand, and the wirings of the transparent electrode wiring section 32 located between the even numbered transparent electrodes, on one hand, and the even numbered electrode terminals, on the other hand, can be formed in a vertical direction relative to the display device, which minimizes the length of the wiring as compared to the conventional device 51 shown in FIG. 3. With such an arrangement, the area occupied by the wiring section 32 in the horizontal direction of the transparent substrate is also reduced and, consequently, the occupied area of display section 31 is increased. As a result, an easy-to-see display can be provided.

Further, since the wiring pattern of transparent electrode wiring section 32 extends in the vertical direction, the intervals each between the wirings, and hence the intervals each between the electrode terminals can be set to be large enough to absorb the tolerances of any parts which may be needed for assembling the LC display device and the printed wiring board. Except for the electrode terminal array and the transparent electrode wiring described above, the basic arrangement of the LC device is equivalent to that of the conventional display device, and hence no further explanation will be given.

The configuration to realize the LSI for LC display according to this invention may be realized in various ways. One of the examples is to modify the layout of the plurality of pixel drive circuits on the LSI chip. Alternatively, a relationship of the output terminals of the drive circuit with the pixel drive signal output pads may be selected by a matrix circuit. Furthermore, in the case of the LC display LSI with a RAM (random access memory) section for display data, it is only needed to modify the address decoder in the RAM section.

An example of the LC display LSI block with the display data RAM section will be described referring to FIG. 8. As shown in the figure, reference numeral 40 designates the display data RAM section to and from which the liquid display data is written into and read out. Reference numeral 41 designates an address decoder for selecting an address. Reference numeral 42 represents an address counter for inputting an address signal to address decoder 41. An interface circuit 43 receives address data and the write data, which are supplied from an external MPU (microprocessor) (not shown), and supplies them as the inputs to address counter 42 and as the write data to RAM 40. A latch circuit section 44 latches the data (the data of a plurality of bits corresponding to the pixels to be displayed) from RAM section 40. A pixel drive circuit section 45 receives the latch data from latch circuit section 44, and outputs a plurality of pixel drive signals for driving the respective pixels to be displayed. The plurality of pixel drive signals are output at the output terminals for the plurality of pixel drive signals via the pixel drive output pads.

Address counter 42 responds to the start address of the display data from the external MPU, and executes its count operation in synchronism with the input clock signal, and designates a predetermined address area in a scanning manner. Address decoder 41 includes a first decoder system and a second decoder system. The first decoder system receives the address signal from address counter 42, and executes the ordinary decode operation so that the input address signal coincide with the address of RAM section 40. The second decoder system functions as follows. The relationship between the address input and the address of RAM section 40 is changed, and a decoding is made so as to make the address select of RAM section 40. The data read out from RAM section 40 appears at the plurality of the pixel drive output terminal via latch circuit section 44 and pixel drive circuit section 45. In such a case, the second decoder system functions so that its output terminal array is equivalent to the odd numbered output terminal array and the even numbered output terminal array as mentioned. Means for selecting the two systems is provided in order to selectively use the two decoder systems, depending on, for example, as to whether a fuse circuit formed on the chip is burned out or not. Alternatively, another means may be provided which selects the two decoder systems, depending on the level of the control voltage applied to the integrated circuit external terminal (control terminal).

In the above-mentioned embodiment, drive signals to be supplied to the common electrode terminals of the LC display device, may be generated by the LC drive circuit. This circuit function may be contained in the LC display LSI.

Furthermore, the output terminals of the LSI may be changed from a mode in which the output terminals are grouped into two array-portions to a mode in which both the odd and even numbered output terminals are alternately located, by controlling the logic level of a control signal supplied to a control terminal of the LSI.

The LC display integrated circuit is not limited to the packaged device with the pixel drive output terminal array as used in the above-mentioned embodiments, but may be the integrated circuit chip having a pixel drive output pad array like the above pixel output terminal array.

It is noted that this invention can be applied to not only the LC display device, but also other display device which is of dot matrix type.

As described above, in the integrated circuit for LC display according to this invention, in assembling the dot matrix type LC display apparatus, the manufacturing cost of the printed wiring board can be reduced, and additionally the reliability of the formed wiring can be improved. Further, the increased ratio of the board area occupied by the display section provides an easy-to-see display.

What is claimed is:

1. A liquid crystal display apparatus of a dot matrix type, comprising:

a liquid crystal display device comprising a first board with pixel electrode terminals being formed on said first board arranged in an array for receiving a plurality of pixel drive signals, said pixel electrode terminals being grouped into two array portions both of which are formed on the same surface of said first board, one of said array portions including odd numbered ones of said pixel electrode terminals successively arranged in the array, said odd numbered pixel electrode terminals being arrayed such that the numbers thereof increase in a predetermined direction, and the other of said array portions including even numbered ones of said pixel electrode terminals successively arranged in the array, said even numbered pixel electrode terminals being arrayed such that the numbers thereof decrease in said predetermined direction; and an integrated circuit comprising a second board with pixel drive signal output terminals being formed on said second board arranged in an array for outputting said plurality of pixel drive signals, said pixel drive signal output terminals being grouped into two array portions, one of the array portions including odd numbered ones of the pixel drive signal output terminals successively arranged in the array and associated with said odd numbered pixel electrode terminals, said odd numbered pixel drive signal output terminals being arrayed such that the numbers thereof increase in said predetermined direction, and the other of the array portions including even numbered ones of said pixel drive signal output terminals successively arranged in the array and associated with the even numbered pixel electrode terminals, said even numbered pixel drive signal output terminals being arrayed such that the numbers thereof decrease in said predetermined direction.

2. A liquid crystal display apparatus of a dot matrix type, comprising:

a liquid crystal display device comprising a first board with pixel electrode terminals being formed on said first board arranged in an array for receiving a plurality of pixel drive signals, said pixel electrode terminals being grouped into two array portions both of which are formed on the same surface of said first board, one of said array portions including odd numbered ones of said pixel electrode terminals successively arranged in the array, said odd numbered pixel electrode terminals being arrayed such that the numbers thereof decrease in a predetermined direction, and the other of said array portions including even numbered ones of said pixel electrode terminals successively arranged in the array, said even numbered pixel electrode terminals being arrayed such that the numbers thereof increase in said predetermined direction; and an integrated circuit comprising a second board with pixel drive signal output terminals being formed on said second board arranged in an array for outputting said plurality of pixel drive signals, said pixel drive signal output terminals being grouped into two array portions, one of the array portions including odd numbered ones of the pixel drive signal output terminals successively arranged in the array and associated with said odd numbered pixel electrode terminals, said odd numbered pixel drive signal output terminals being arrayed such that the numbers thereof decrease in said predetermined direction, and the other of the array portions including even numbered ones of said pixel drive signal output terminals successively arranged in the array and associated with the even numbered pixel electrode terminals, said even numbered pixel drive signal output terminals being arrayed such that the numbers thereof increase in said predetermined direction.

* * * * *